US011613132B2

(12) United States Patent
Juriasingani et al.

(10) Patent No.: US 11,613,132 B2
(45) Date of Patent: Mar. 28, 2023

(54) PRINT RIBBON RESIDUAL IMAGE SCRAMBLING TECHNIQUES USING METADATA

(71) Applicant: Entrust Corporation, Shakopee, MN (US)

(72) Inventors: Rajesh Juriasingani, Shakopee, MN (US); Justin Engelking, Shakopee, MN (US)

(73) Assignee: Entrust Corporation, Shakopee, MN (US)

( * ) Notice: Subject to any disclaimer, the term of this patent is extended or adjusted under 35 U.S.C. 154(b) by 0 days.

(21) Appl. No.: 17/489,136

(22) Filed: Sep. 29, 2021

(65) Prior Publication Data

US 2022/0105733 A1 Apr. 7, 2022

Related U.S. Application Data

(60) Provisional application No. 63/086,443, filed on Oct. 1, 2020.

(51) Int. Cl.
*B41J 3/28* (2006.01)
*B41J 2/32* (2006.01)

(52) U.S. Cl.
CPC .. *B41J 3/28* (2013.01); *B41J 2/32* (2013.01)

(58) Field of Classification Search
CPC ..... B41J 3/28; B41J 2/32; B41J 2/325; B41J 13/12; B41J 2/35; B41J 2/355;
(Continued)

(56) References Cited

U.S. PATENT DOCUMENTS 4,531,135 A 7/1985 Toshima
4,651,162 A 3/1987 Nakamura
(Continued)

FOREIGN PATENT DOCUMENTS

FR 2988509 A1 9/2013
JP 3484246 1/2004
(Continued)

OTHER PUBLICATIONS

International Search Report and Written Opinion, International Patent Application No. PCT/IB2021/058967, dated Jan. 3, 2022 (6 pages).

(Continued)

*Primary Examiner* — Kristal Feggins
(74) *Attorney, Agent, or Firm* — Hamre, Schumann, Mueller & Larson, P.C.

(57) ABSTRACT

Techniques for scrambling residual images left behind on print ribbons due to printing on plastic cards or passports. A string of characters to be printed onto a plastic card is divided into character subsets. Metadata is assigned to each character subset, with the metadata defining the print sequence and location on the plastic card of each character subset. The character subsets are then printed on the plastic card in the sequence and the locations determined by the metadata. The sequence of characters in a residual image left on the print ribbon after printing of the character string differs from the sequence of the characters in the character string printed on the plastic card or passport.

19 Claims, 9 Drawing Sheets

(58) Field of Classification Search
CPC ..... B41J 2/3551; B41J 2/3553; B41J 2/3555; B41J 2/3556; B41J 2/3558
See application file for complete search history.

(56) References Cited

U.S. PATENT DOCUMENTS

| | | | |
|---|---|---|---|
| 4,825,054 | A | 4/1989 | Rust et al. |
| 4,845,549 | A | 7/1989 | Someya |
| 4,995,501 | A | 2/1991 | Lundstrom et al. |
| 5,266,781 | A | 11/1993 | Warwick et al. |
| 5,837,991 | A | 11/1998 | LaManna et al. |
| 6,131,817 | A | 10/2000 | Miller |
| 6,262,755 | B1 | 7/2001 | Skubic et al. |
| 6,783,067 | B2 | 8/2004 | Kreuter et al. |
| 6,891,555 | B2 | 5/2005 | Minowa et al. |
| 6,894,710 | B2 | 5/2005 | Suzuki et al. |
| 6,902,107 | B2 | 6/2005 | Shay et al. |
| 7,021,666 | B2 | 4/2006 | Hare |
| 7,398,972 | B2 | 7/2008 | Schuller et al. |
| 7,434,728 | B2 | 10/2008 | Paulson et al. |
| 7,839,425 | B2 | 11/2010 | Morrison |
| 8,231,935 | B2 | 7/2012 | Ihara et al. |
| 8,292,167 | B2 | 10/2012 | Behner et al. |
| 8,668,396 | B2 | 3/2014 | Ihara |
| 8,933,978 | B1 | 1/2015 | Fowell |
| 9,007,649 | B2 | 4/2015 | Higashi et al. |
| 9,079,423 | B2 | 7/2015 | Bouverie |
| 9,248,680 | B2 | 2/2016 | Flitsch et al. |
| 10,232,640 | B2 | 3/2019 | Merlet |
| 10,427,429 | B2 | 10/2019 | Godard |
| 2004/0109715 | A1 | 6/2004 | Meier et al. |
| 2007/0187870 | A1 | 8/2007 | Lundstrom et al. |
| 2008/0121699 | A1 | 5/2008 | Thorsen et al. |
| 2011/0247509 | A1* | 10/2011 | Choi ..... B41J 13/12 101/250 |
| 2012/0027264 | A1* | 2/2012 | Yamaguchi ..... H04N 1/00076 382/112 |
| 2013/0002786 | A1 | 1/2013 | Ihara et al. |
| 2013/0032587 | A1 | 2/2013 | Flitsch et al. |
| 2014/0132967 | A1 | 5/2014 | Higashi et al. |
| 2014/0300910 | A1* | 10/2014 | Tokishige ..... G06F 3/1261 358/1.6 |
| 2016/0271969 | A1 | 9/2016 | Ihara |
| 2018/0134050 | A1 | 5/2018 | Merlet |
| 2019/0092059 | A1 | 3/2019 | Sawada et al. |
| 2019/0366750 | A1 | 12/2019 | Knaack et al. |
| 2020/0094603 | A1* | 3/2020 | Nemoto ..... G06K 19/06037 |

FOREIGN PATENT DOCUMENTS

| | | | |
|---|---|---|---|
| JP | 2005-014398 | A | 1/2005 |
| JP | 2008-114383 | A | 5/2008 |
| JP | 2010-115861 | A | 5/2010 |
| KR | 10-2006-0112125 | | 10/2006 |
| WO | 92/17856 | | 10/1992 |
| WO | 2013-137880 | A1 | 9/2013 |
| WO | 2017/162601 | A1 | 9/2017 |

OTHER PUBLICATIONS

International Search Report and Written Opinion for International Application No. PCT/US2015/041906, dated Oct. 15, 2015 (13 pages).

* cited by examiner

80

| Character Subset | Metadata |
| --- | --- |
| 1 | Print sequence 1; print coordinates definition 1 |
| 2 | Print sequence 2; print coordinates definition 2 |
| n | Print sequence n; print coordinates definition n |

Fig. 5

| Character Subset | Metadata (y = 18, 42) Print sequence | Location |
|---|---|---|
| 1 | 5 | X = 23, 38 |
| 2 | 3 | X = 41, 56 |
| 3 | 2 | X = 59, 74 |
| 4 | 1 | X = 77, 92 |
| 5 | 6 | X = 95, 110 |
| 6 | 4 | X = 113, 128 |

80

PRINT RIBBON RESIDUAL IMAGE SCRAMBLING TECHNIQUES USING METADATA

FIELD

This technical disclosure relates generally to printing on plastic cards including, but not limited to, financial (e.g., credit, debit, or the like) cards, driver's licenses, national identification cards, business identification cards, gift cards, and other plastic cards.

BACKGROUND

Plastic cards are commonly printed in a plastic card processing system that has a card printing mechanism with at least one print head and at least one print ribbon. As a result of transferring the ink from the print ribbon, a residual image of the printed image is left on the print ribbon. The residual image can contain sensitive information such as a personal account number, a card verification value (CVV), the name of the intended cardholder, a portrait image of the intended cardholder, a driver's license number, date of birth of the cardholder, and the like. Unless the print ribbon is destroyed or the residual image is obscured, someone may be able to obtain the sensitive information from the print ribbon for unauthorized purposes such as creating a fraudulent plastic card, making unauthorized purchases using the obtained information, or stealing the cardholder's identity.

U.S. Pat. No. 9,007,649 discloses one known technique for scrambling a residual image on a print ribbon by changing the printing order of the characters on the card so that the residual image of the characters left behind on the print ribbon does not match the printed character string on the plastic card. The technique disclosed in U.S. Pat. No. 9,007,649 has limitations since the technique divides the printing image into a plurality of divided images, and rearranges the arrangement order of the divided images. Dividing the printing image and rearranging the arrangement order of the divided images requires a significant amount of data processing which may not be available on many conventional plastic card processing systems.

SUMMARY

Techniques are described for scrambling residual images left behind on print ribbons due to printing on plastic cards or passports. Scrambling the residual images on the print ribbons makes it significantly more difficult to discern, using the residual images, the sensitive or personalized data that has been printed on the plastic cards. The plastic cards can be financial (e.g., credit, debit, or the like) cards, driver's licenses, national identification cards, business identification cards, gift cards, and other plastic or composite cards which bear personalized data unique to or assigned specifically to the cardholder and/or which bear other card information. The term "plastic card" as used herein is intended to encompass cards that are completely or substantially plastic, as well as cards that have non-plastic or composite components and cards having other formulations that function like the card types indicated above. The technique described herein can also be used on print ribbons used to print on passports and other personalized security documents.

Cards that are encompassed by the term "plastic cards" as used herein often bear printed personalized data unique to or assigned specifically to the cardholder, such as the name of the cardholder, an account number, a CVV, an image of the face of the cardholder, a driver's license number, date of birth of the cardholder, and other data. In some embodiments, the cards can include a magnetic stripe and/or integrated circuit chip that holds/stores personalized data unique to or assigned specifically to the cardholder. Unauthorized access to the personalized data can be used for illegitimate purposes, such as creating a fraudulent plastic card, making unauthorized purchases, or identity theft.

As used herein, the term "scramble", "scrambling" and the like is intended to refer to a sequence of characters appearing in a residual image left on the print ribbon after printing of a character string on a plastic card differing from the sequence of the characters in the character string appearing on the plastic card. In some embodiments, the entire sequence of characters appearing in the residual image may differ from the sequence of the characters in the character string appearing on the plastic card. In other embodiments, only a portion of the sequence of characters appearing in the residual image may differ from the sequence of the characters in the character string appearing on the plastic card.

In the techniques described herein, a string of characters to be printed onto a plastic card is divided into character subsets. Metadata is assigned to each character subset, with the metadata defining the print sequence and location on the plastic card of each character subset. The character subsets are then printed on the plastic card in the sequence and the locations determined by the metadata. Unlike in U.S. Pat. No. 9,007,649, the arrangement order of the character subsets is not rearranged. The rendering of the data, which includes division into the character subsets and the assigning of the metadata to the character subsets, can occur remote from the plastic card printing system that performs the printing, or can occur on the plastic card printing system. For example, the data necessary to perform the printing can be rendered by a data renderer that is remote from the plastic card printing system that performs the printing. In another embodiment, the data renderer can be integrated into or part of the plastic card printing system that performs the printing. The data rendering can be implemented by software, firmware or a combination of software and firmware.

In one embodiment, a plastic card printing system can include a plastic card printer having a printing mechanism that includes a thermal printhead and a thermal print ribbon, and a data renderer that is configured to render print data to print a character string composed of a plurality of characters on a plastic card using the thermal printhead and the thermal print ribbon. In some embodiments, the data renderer may be part of a rendering engine that has the ability to render images to be printed as well as render the print data. The data renderer divides the character string into a plurality of character subsets prior to printing of the character string, the character subsets having a character subset sequence, and the data renderer associates metadata with each character subset that determines a printing sequence of the character subsets and a printing position of each character subset on the plastic card. The printing sequence differs from the character subset sequence so that a sequence of characters in a residual image left on the thermal print ribbon after printing of the character string differs from the sequence of the characters in the character string printed on the plastic card.

In another embodiment, a method of controlling a printing mechanism of a plastic card printer to print a character string composed of a plurality of characters on a plastic card using a thermal printhead and a thermal print ribbon of the printing mechanism is described. The method can include, prior to printing of the character string, dividing the character string into a plurality of character subsets having a character subset sequence. Thereafter, metadata is associated with each character subset that determines a printing sequence of the character subsets and a printing position of each character subset on the plastic card, wherein the printing sequence differs from the character subset sequence so that a sequence of characters in a residual image left on the thermal print ribbon after printing of the character string differs from the sequence of the characters in the character string printed on the plastic card. The character subsets, the thermal printhead and the thermal print ribbon are then used to print the character string on the plastic card.

In another embodiment, a data renderer is described that is configured for communication with a plastic card printer having a printing mechanism to print a character string composed of a plurality of characters on a plastic card using a thermal printhead and a thermal print ribbon of the printing mechanism. The data renderer, which can be remote from the plastic card printer or integrated into the plastic card printer, divides the character string into a plurality of character subsets having a character subset sequence, and the data renderer also associates metadata with each character subset that determines a printing sequence of the character subsets and a printing position of each character subset on the plastic card. The data renderer may also render one or more images to be printed. The printing sequence differs from the character subset sequence so that a sequence of characters in a residual image left on the thermal print ribbon after printing of the character string would differ from the sequence of the characters in the character string to be printed on the plastic card.

The techniques described herein can be utilized with any plastic card printing mechanism that prints using at least one print head and at least one print ribbon. In one embodiment, the plastic card printing mechanism can be a direct-to-card thermal card printing mechanism where the printing is applied directly to a surface of the plastic card from at least one thermal print ribbon using at least one thermal print head. In another embodiment, the plastic card printing mechanism can be a retransfer printing mechanism where the characters are printed onto an intermediate retransfer material by transferring ink from at least one thermal print ribbon onto the intermediate retransfer material using at least one thermal print head. After the characters are printed, the intermediate retransfer material is transferred by lamination onto the surface of the plastic card.

DRAWINGS

FIGS. 4A-D illustrate different examples of character subsets.

FIG. 5 is a table showing character subsets and associated metadata for each character subset.

Figure 4B:
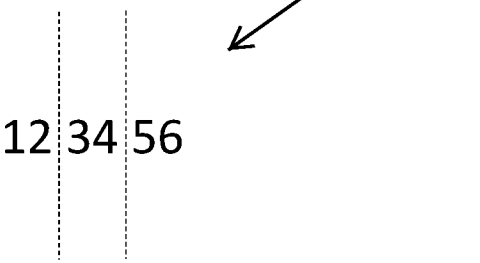
Figure 4D:
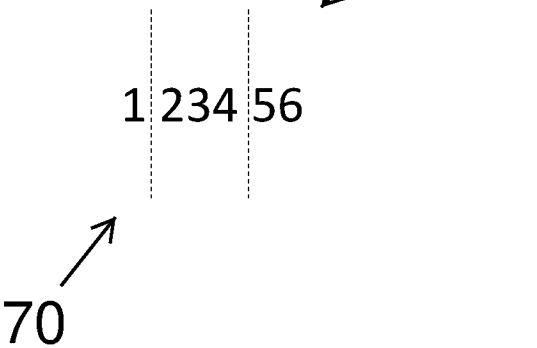
Figure 4A:
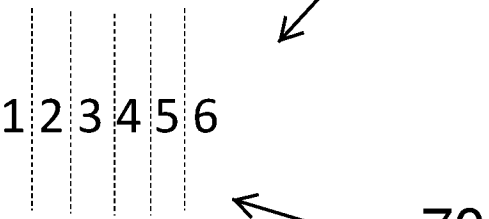
Figures 6A, 6B:
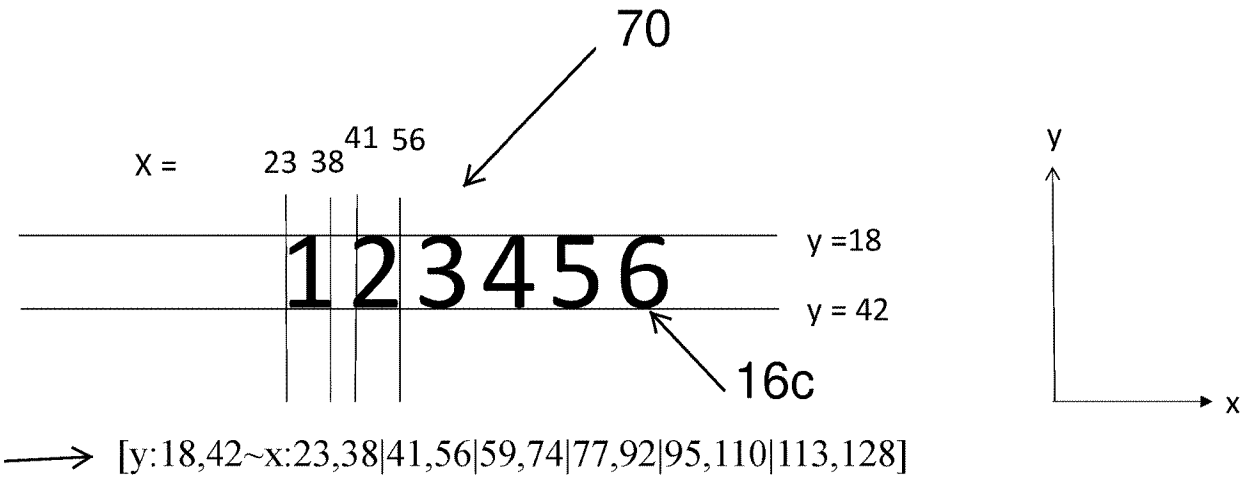

FIGS. 6A and 6B illustrate a specific example of a character string, character subsets, and metadata for each character subset using the example in FIG. 4A.

Figure 7:
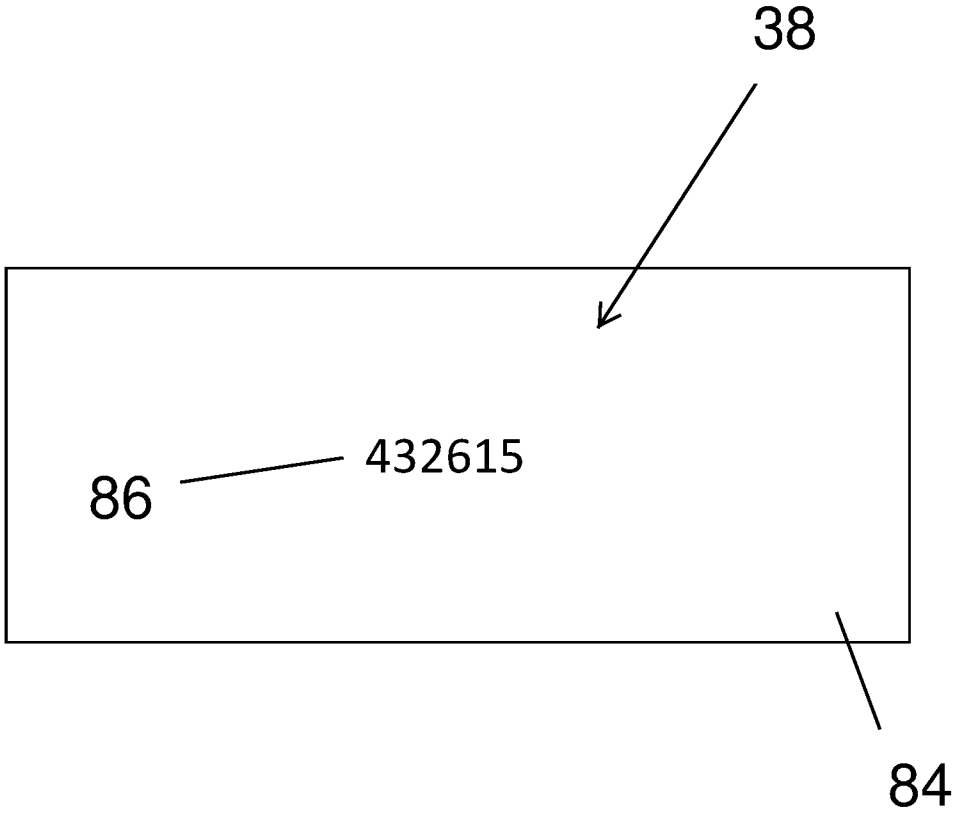

FIG. 7 illustrates a section of a print ribbon after printing the character string on the plastic card.

Figure 8:
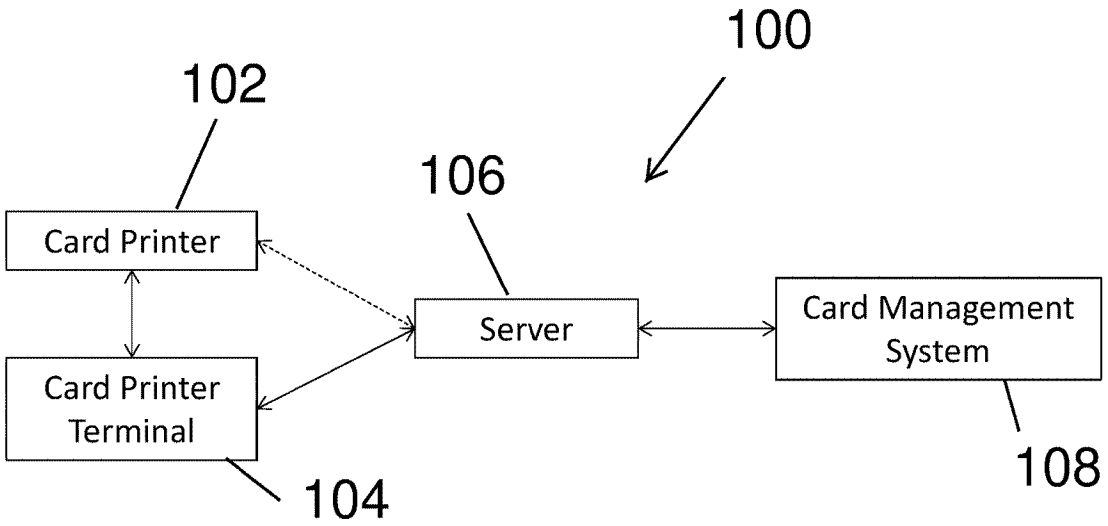

FIG. 8 schematically illustrates an example of a card processing system that can utilize the plastic card printing system described herein.

Figure 9:
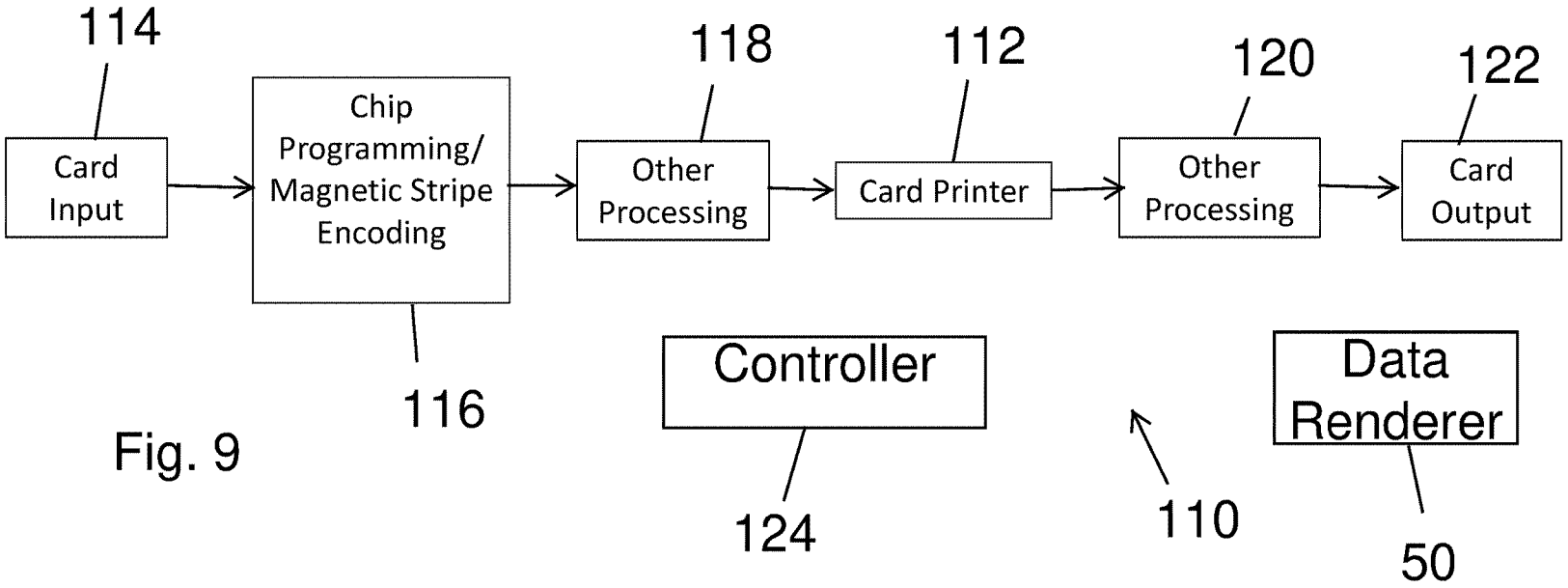

FIG. 9 schematically illustrates another example of a card processing system that can utilize the plastic card printing system described herein.

Figure 10:
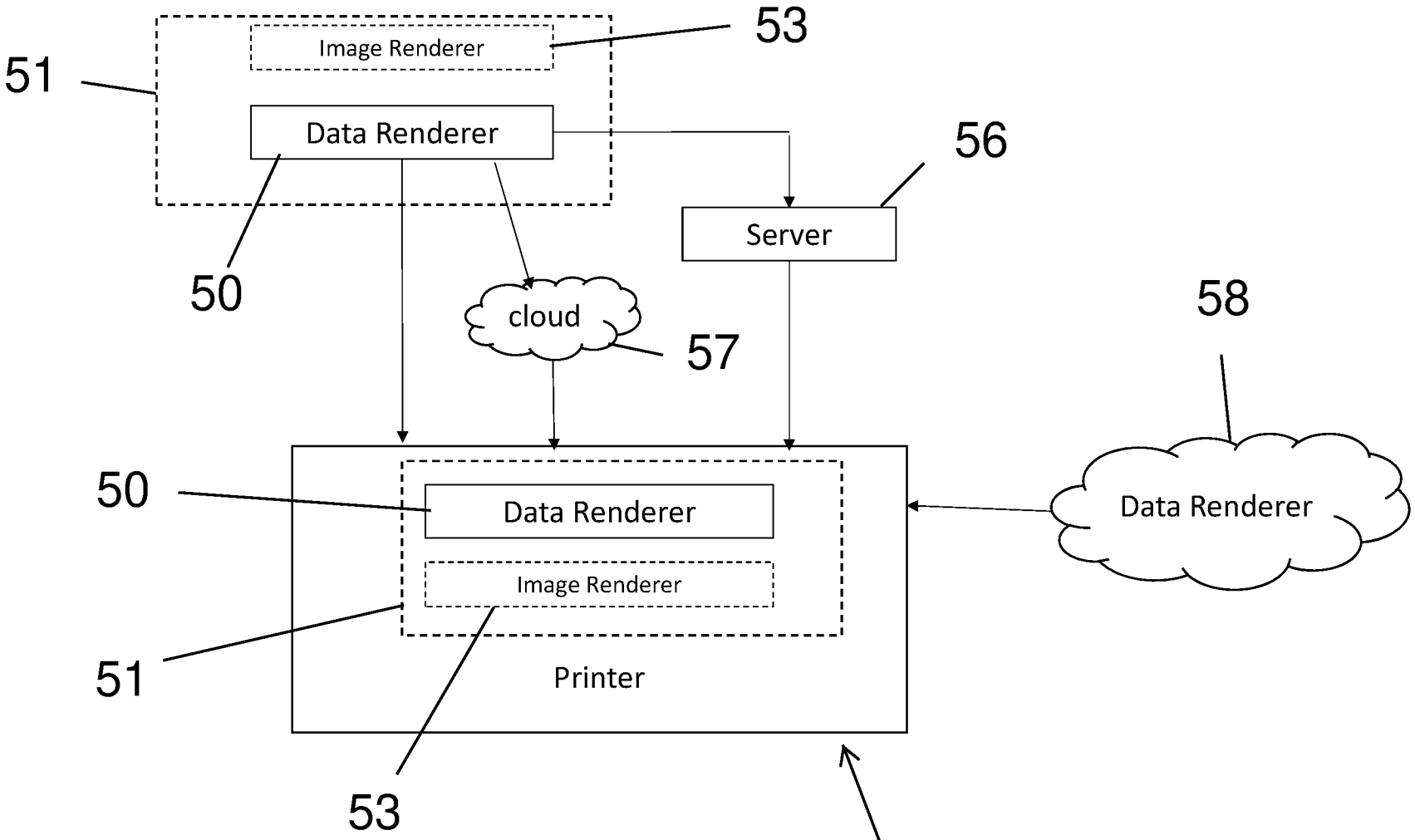

FIG. 10 schematically illustrates examples of different options for dividing the character string and associating the metadata and communicating the rendered data to the printer.

DETAILED DESCRIPTION

The following description describes a number of techniques for scrambling residual images on print ribbons that have been used to print on plastic cards. Scrambling the residual images on the print ribbons prevents access to sensitive or personalized data appearing in the residual images. Cards that are encompassed by the term "plastic cards" often bear printed personalized data unique to or assigned specifically to the cardholder, such as the name of the cardholder, an account number, a CVV, an image of the face of the cardholder, a driver's license number, date of birth of the cardholder, and other data. In some embodiments, the cards can include a magnetic stripe and/or integrated circuit chip that holds/stores personalized data unique to or assigned specifically to the cardholder. Unauthorized access to the personalized data can be used for illegitimate purposes, such as creating a fraudulent plastic card, making unauthorized purchases, or identity theft.

The plastic cards can be financial (e.g., credit, debit, or the like) cards, driver's licenses, national identification cards, business identification cards, gift cards, and other plastic or composite cards which bear personalized data unique to or assigned specifically to the cardholder and/or which bear other card information. The term "plastic card" as used herein is intended to encompass cards that are completely or substantially plastic, as well as cards that have non-plastic or composite components and cards having other formulations that function like the card types indicated above.

As described in further detail below, a string of characters is printed onto a surface of a plastic card. Prior to printing, the string of characters is divided into character subsets. Metadata is assigned to each character subset, with the metadata defining the print sequence and location on the plastic card of each character subset. The character subsets are then printed on the plastic card in the sequence and the locations determined by the metadata. The sequence of characters appearing in the residual image left on the print ribbon after printing of the character string on the plastic card differs from the sequence of the characters in the character string appearing on the plastic card. Accordingly, the sequence of the characters appearing in the residual image left on the print ribbon can be considered scrambled since the sequence differs from the actual printed sequence on the plastic card. The rendering of the print data described herein includes at least dividing the characters into the character subsets and assigning or associating the metadata with each character subset. The data rendering can be performed by a data renderer at a location remote from the plastic card printer, or can occur on the plastic card printer. In some embodiments, some of the rendering of the print data, such as dividing the characters into the character subsets, can occur at a location remote from the plastic card printer while other parts of the rendering, such as assigning or associating the metadata with each character subset, can occur on the plastic card printer. In some embodiments, the data renderer may be part of a rendering engine that has the ability to render one or more images to be printed as well as render the print data.

The characters that are printed on the plastic card can be numbers, letters, symbols, and combinations thereof. In one embodiment, there can be a minimum of three printed characters forming the character string printed on the plastic card, with no maximum upper limit on the number of printed characters. In another embodiment, there can be five printed characters forming the character string printed on the plastic card. In still another embodiment, there can be twelve or sixteen printed characters forming the character string printed on the plastic card. The characters can be uppercase, lowercase, can have any font size, font type, character spacing, and the like that one may wish to use.

The layout and content of the printed characters on the card, and the data rendering described herein, can be implemented using suitable card design, issuance and management software known in the art. Examples of suitable card design, issuance and management software that can be used are the Entrust™ TruCredential™ and CardWizard® software available from Entrust Corporation of Shakopee, Minn.

Figure 1:
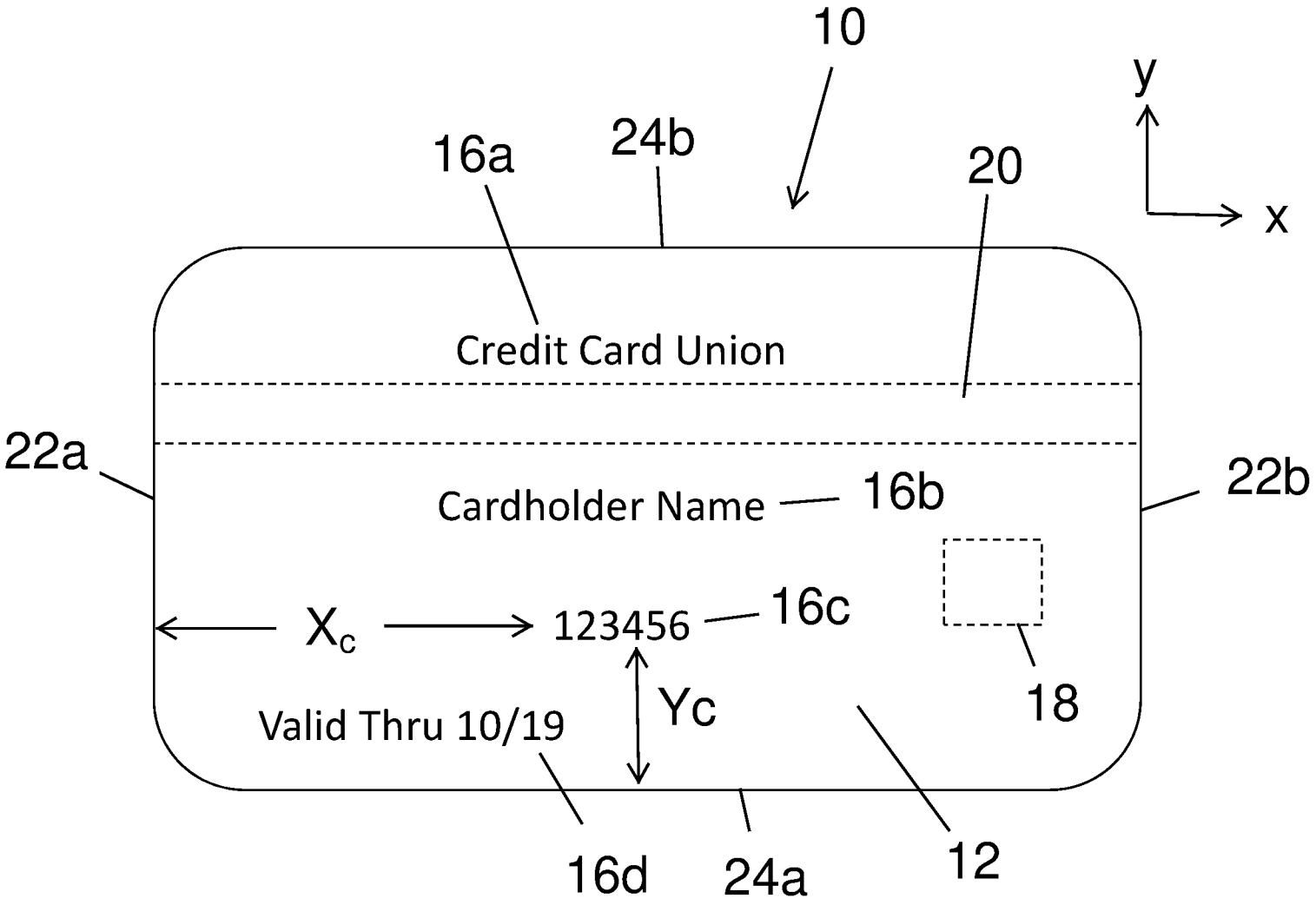
FIG. 1 is a top view of a surface of a plastic card containing at least one printed character string described herein.

Referring initially to FIG. 1, an example of a plastic card 10 is illustrated. The card includes a first surface 12 and a second surface 14 (visible in FIG. 2). The first surface 12 can be considered either a front or top surface, or a rear or bottom surface. Similarly, the second surface 14 can be considered either a rear or bottom surface, or a front or top surface. The card 10 can include various printed character strings printed on either the first surface 12 as indicated in FIG. 1 and/or printed on the second surface 14. The printed character strings can include, but are not limited to, a name of the card issuer 16*a*, a name of the cardholder 16*b*, an account number 16*c* assigned to the cardholder, expiration data 16*d*, a CVV (not shown) and other data. In some embodiments, an image (not shown) of the cardholder may also be printed on either the first surface 12 or the second surface 14. The card 10 can also optionally include an integrated circuit chip 18 and/or optionally include a magnetic stripe 20.

With continued reference to FIG. 1, the card 10 is generally rectangular with opposite short end edges 22*a*, 22*b*, opposite longitudinal side edges 24*a*, 24*b*, and four rounded corners. Each one of the printed character strings 16*a-d* starts a respective distance $X_c$ that can be measured from either one of the edges 22*a*, 22*b*. For example, referring to the account number string 16*c*, the first character of the account number string 16*c* starts the distance $X_c$ from the edge 22*a*. Similarly, each one of the printed character strings 16*a-d* starts a respective distance $Y_c$ that can be measured from either one of the edges 24*a*, 24*b*. For example, referring to the account number string 16*c*, the first character of the account number string 16*c* starts the distance $Y_c$ from the edge 24*a*.

In the examples illustrated herein, the direction X is intended to refer to a direction that is parallel to a longitudinal direction of the card 10 or parallel to a longitudinal direction of a print ribbon (see FIG. 2), or a direction extending between the end edges 22*a*, 22*b* of the card 10, or a direction that is parallel to the magnetic stripe 20 (if present) of the card, or a direction that is parallel to a transport direction D (see FIG. 2) of the card 10 or parallel to the transport direction D of the ribbon. In the examples illustrated herein, the direction Y is intended to refer to a direction perpendicular to the X direction or perpendicular to a longitudinal direction of the card 10 or perpendicular to the longitudinal direction of the print ribbon, or parallel to a direction extending between the side edges 24*a*, 24*b* of the card 10, or a direction that is perpendicular to the magnetic stripe 20 (if present) of the card 10, or a direction that is perpendicular to the transport direction D of the card 10 or perpendicular to the transport direction D of the print ribbon.

Figure 2:
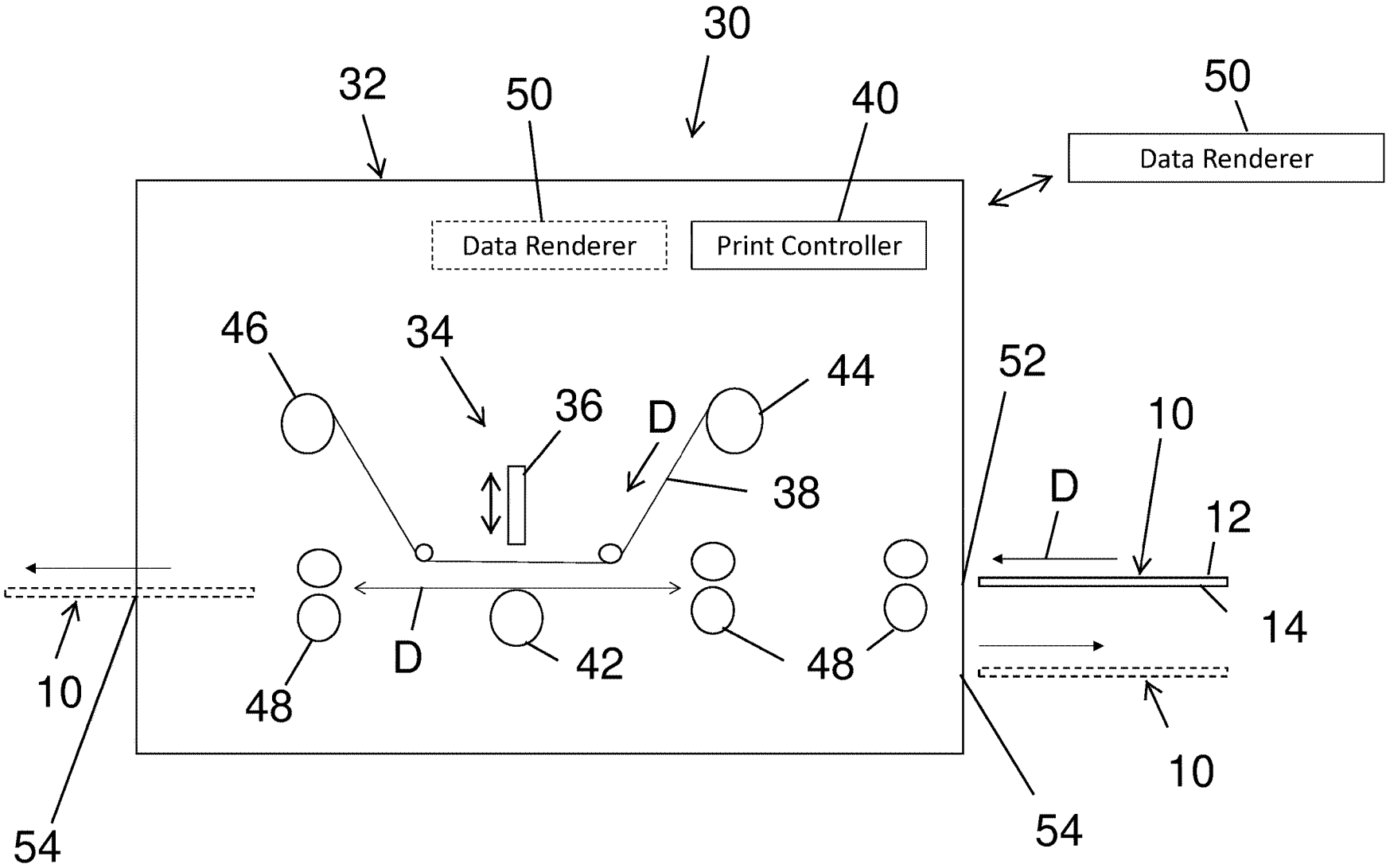
FIG. 2 is a schematic illustration of a portion of a plastic card printing system described herein.

FIG. 2 illustrates a portion of a plastic card printing system 30 that can perform the printing described herein. The system 30 includes a plastic card printer 32 having a printing mechanism 34 that includes a thermal printhead 36 and a thermal print ribbon 38. The card printer 32 further includes mechanical card transport mechanism(s) that are well known in the art of card handling within card printers and card processing systems. The system 30 further includes a print controller 40 connected to the plastic card printer 32 that controls various operations of the card printer 32 such as controlling the various elements of the printing mechanism 34 and the transport mechanism. The construction and operation of the various components of the card printer 32, including the printing mechanism 34 and the card transport mechanism(s) are well known in the art.

The printhead 36 is actuatable so as to be movable toward and away from a platen 42 which supports the card 10 during printing. The printhead 36 includes an array of resistive elements each of which can be selectively heated by controlling the flow of electricity to the individual resistive elements under control of the print controller 40. The print ribbon 38 can be a monochromatic ribbon bearing a single color of ink such as, but not limited to, black, gold or silver ink. The monochromatic print ribbon may also include primer material separate from the ink color. Alternatively, multi-color printing can be performed whereby the print ribbon 38 may be a multi-color print ribbon bearing discrete panels of differently colored inks arranged in a repeating sequence. For example, the print ribbon 38 can include cyan (C), magenta (M), yellow (Y) and black (K) ink panels (i.e. a CMYK ribbon). The print ribbon 38 can include additional colored ink panels such as gold or silver, and/or panels of primer material, and/or panels of specialty materials such as fluorescent material. The print ribbon 38 is supplied from a print ribbon supply 44 with used ribbon 38 being wound on a print ribbon take-up 46.

Examples of the card transport mechanisms that could be used are known in the art and include, but are not limited to, transport rollers, transport belts (with tabs and/or without tabs), vacuum transport mechanisms, transport carriages, and the like and combinations thereof. Card transport mechanisms are well known in the art including those disclosed in U.S. Pat. Nos. 6,902,107, 5,837,991, 6,131,817, and 4,995,501 and U.S. Published Application No. 2007/0187870, each of which is incorporated herein by reference in its entirety. A person of ordinary skill in the art would readily understand the type(s) of card transport mechanisms that could be used, as well as the construction and operation of such card transport mechanisms. FIG. 2 illustrates the card printer 32 as including sets of rollers 48 used to transport the card 10 in the card printer 32. The transport mechanism is reversible so that the card 10 can be transported in forward and reverse directions D in the card printer 32.

With continued reference to FIG. 2, in one embodiment a data renderer 50 that divides the characters into the character subsets and assigns or associates the metadata with each character subset can be provided that is separate and remote from the card printer 32 (in which case the data renderer 50 can be referred to as a remote data renderer). In this embodiment, the data from the data renderer 50 is suitably transmitted to the card printer 32. In another embodiment illustrated in dashed lines in FIG. 2, the data renderer 50 can be incorporated into the card printer 32 (in which case the data renderer 50 can be referred to as a local data renderer)

The local data renderer 50 can be separate from the print controller 40 or incorporated into the print controller 40. In still another embodiment, a combination of data rendering using a remote data renderer 50 and a local data renderer 50 can be implemented, with some of the data rendering, such as the character string division into character subsets, occurring on the remote data renderer 50 and some of the data rendering, such as associating the metadata with the character subsets, occurring on the local data renderer 50. The data renderer 50, whether remote or local, may be part of a rendering engine that has the ability to render one or more images to be printed on the card as well as render the print data (e.g. divide the characters in the character subsets and assign or associate the metadata with each character subset).

Referring to FIG. 10, non-limiting examples of rendering the print data and communicating the rendered print data to the card printer 32 are depicted. The data can be rendered via the remote data renderer 50 which in turn can be in direct wired or wireless communication with the card printer 32 using known wired and wireless communication technologies. Alternatively, the remote data renderer 50 can communicate the rendered data to the card printer 32 via a server 56 or via the cloud 57. In another embodiment, the data renderer 50 can be a local data renderer incorporated directly in the card printer 32. In still another embodiment, some or all of the data rendering can be performed on the cloud 58. FIG. 10 also depicts that the data renderer 50 can be part of a rendering engine 51 (shown in dashed lines) that can include an image renderer 53 (shown in dashed lines) that renders one or more images to be printed on the card by the card printer 32.

Returning to FIG. 2, a card 10 can be input into the card printer 32 via a card input 52. In the illustrated example, the card input 52 is depicted as located at an end of the card printer 32. However, the input 52 can be located at other locations of the card printer 32, such as at the other end, at the top, or at the bottom of the card printer 32. The card input 52 can be an opening or slot that permits input of the card 10 from an upstream card processing mechanism or input a new card that has yet to be processed, or the card input 52 can be an input hopper that holds a plurality of cards to be processed. A card 10 can be output from the card printer 32 through a card output 54. In one embodiment, the card output 54 can be located at the end of the card printer 32 opposite the input 52. In another embodiment, the output 54 can be located at the same end of the card printer 32 as the input 52. The card output 54 can be an opening or slot that permits output of the card 10 to a downstream card processing mechanism for additional processing of the card or output the processed card, or the card output 54 can be an output hopper that holds a plurality of cards that have been processed.

Figure 3:
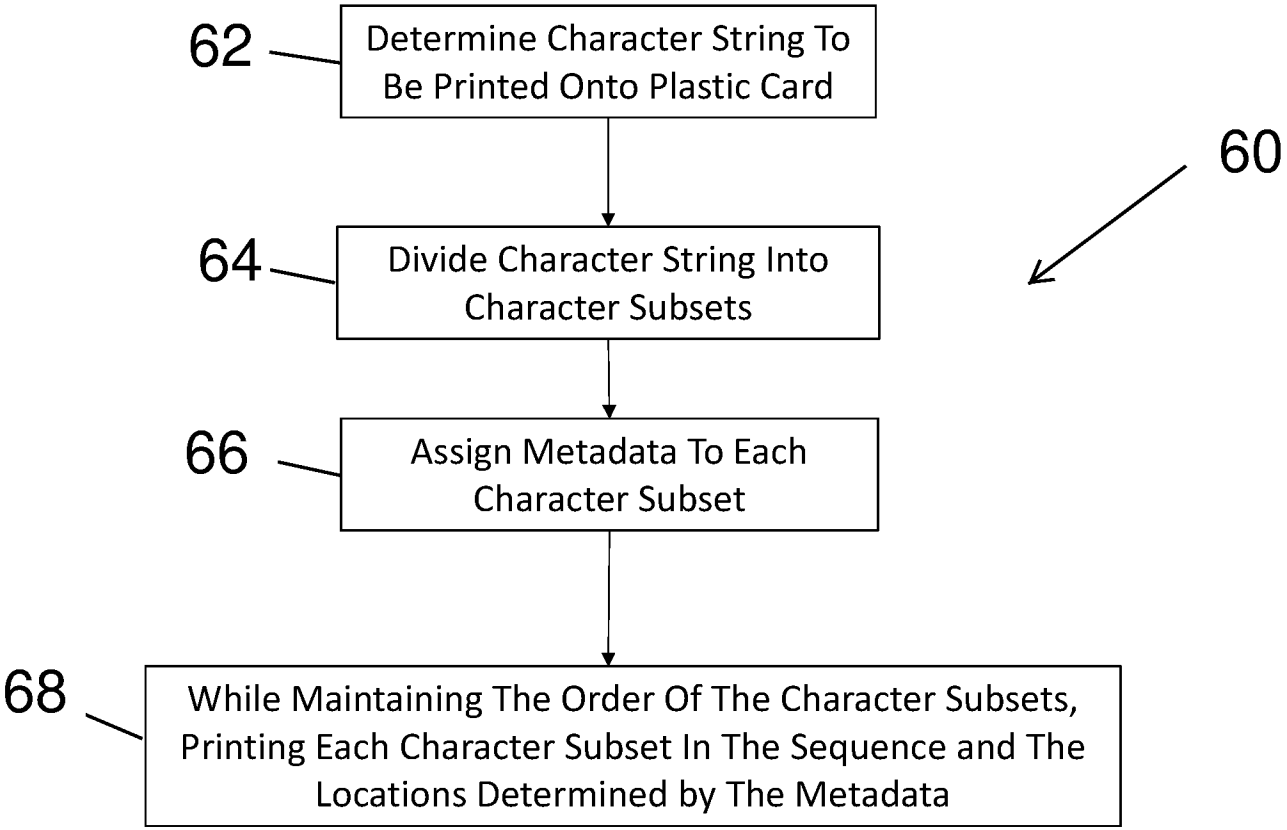
FIG. 3 illustrates a method described herein.

FIG. 3 illustrates an example of a method 60 described herein. In the method 60, a string of characters to be printed onto a surface of the plastic card is divided into character subsets. Metadata is then assigned to each character subset, with the metadata defining the print sequence and location on the plastic card of each character subset. The character subsets are then printed on the plastic card in the sequence and the locations determined by the metadata. In particular, in a first step 62, a character string to be printed onto the plastic card is determined. For example, the character string can be one of the character strings 16*a-d* in FIG. 1.

Once the character string is determined, the character string is then divided into a plurality of character subsets in step 64. The number of character subsets can be any number that one considers suitable to achieve a desired scrambling of the residual data on the print ribbon. As used herein, division of the character string is intended to be construed broadly and encompass and include, but not be limited to, dividing the data representing the character string into subsets, dividing an image of the character string into image subsets, and any other description of how subsets as described herein can be formed from the character string to be printed.

Metadata is then generated and assigned to each one of the character subsets in step 66. The metadata performs at least two functions: a) define a sequence of when each individual character subset is to be printed; and b) define a location on the card where each character subset is to be printed. In some embodiments, the metadata may also indicate the type of font to be used to print each character subset, the color of each character to be printed, the ribbon type to be used to perform printing of each character subset, and others.

In step 68, the rendered data with the character subsets with the associated metadata is then used to control the printing mechanism 34 to print the character subsets on the card in the printing sequence and at the locations determined by the metadata. The character subsets generated by the print controller 40 are not rearranged in sequence. Instead, the order of the character subsets maintains the original order of the characters in the character string to be printed. However, the printing sequence determined by the metadata results in the character subsets being printed in a sequence such that the correct character string is printed on the card but the residual image of the character sequence left behind on the print ribbon differs from the sequence of the characters in the printed character string.

With reference to FIGS. 4A-D, examples of dividing a character string into a plurality of character subsets in step 64 of FIG. 3 are illustrated. For purposes of explaining the concepts herein, this example will assume that the character string being divided is the account number 16*c* depicted in FIG. 1. However, the character string can be any of the character strings found on the card 10. The character string is divided into at least two character subsets. There is no upper limit on the number of character subsets. In general, the more character subsets there are, the more secured the resulting residual image on the print ribbon. Each character subset includes at least one character (number, letter, symbol, etc.) of the character string. Each character subset can include the same number of characters or some or all of the character subsets can include a different number of characters from each other.

Figure 4C:
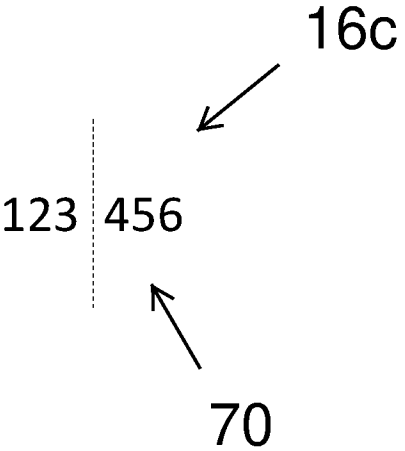

FIG. 4A illustrates the account number 16*c* being divided into six character subsets 70, one subset for each number, letter or symbol in the account number 16*c*. FIG. 4B illustrates the account number 16*c* being divided into three character subsets 70, with each subset including two adjacent numbers, letters or symbols in the account number 16*c*. FIG. 4C illustrates the account number 16*c* being divided into two character subsets 70, with each subset including three adjacent numbers, letters or symbols in the account number 16*c*. FIG. 4D illustrates the account number 16*c* being divided into three character subsets 70, with at least some of the subsets having different amounts of the numbers, letters or symbols in the account number 16*c*. The dashed lines in FIGS. 4A-D are added for illustration purposes to denote the dividing line between each character subset 70. The dashed lines do not necessarily actually exist when the character subsets 70 are created.

Once the character subsets are generated, metadata is then generated and assigned to each one of the character subsets in step 66 of FIG. 3. The metadata determines the sequence in which each one of the character subsets is printed, and the location or print coordinates of each character subset. For example, to help explain the concepts herein, FIG. 5 depicts a table 80 showing character subsets 1, 2, . . . n and associated metadata for each character subset that indicates the print sequence and print coordinates definition for each character subset.

FIGS. 6A and 6B illustrate a specific example of the table 80 using the character subset 70 example of FIG. 4A. FIG. 6A depicts the account number 16*c* divided into the six character subsets 70. Each character has X-coordinate start and end positions or boundaries, and Y-coordinate start and end positions or boundaries. In this example, the characters used in the account number 16*c* are shown as having the same character height in which case each character will have the same Y-coordinate start and end positions. The characters used in the account number 16*c* are also shown as having the same character width so the X-coordinate widths will be the same. The X and Y coordinates for each character are indicated in the string 82 in FIG. 6A. However, one or more of the characters can have different heights and/or widths from other characters.

In one embodiment, one or more of the characters in a character string can have different heights (for example, the first character may be upper case while the following characters can be lower case). In this embodiment, the metadata can include the Y-coordinate boundaries for the entire character string rather than and/or in addition to Y-coordinate boundaries for each character. Including the Y-coordinate boundaries for the entire character string allows the card printing system 30 to determine "lanes" that can be printed on, i.e. the system 30 can determine if any character string has the potential to be overlapping on the horizontal with another character string. Each lane will allow the card printer to fully rewind the ribbon to the beginning of a section of the ribbon being used to print to aid with ribbon optimization.

The table 80 in FIG. 6B shows each character in each character subset, and an example of a print sequence of each character subset and X-coordinates for each character subset. This examples assumes the Y-coordinates are the same, and the Y-coordinates can be included in the metadata for each character subset. In this example, it is assumed that the character 4 is printed first, followed by the character 3, followed by the character 2, followed by the character 6, followed by the character 1, followed by the character 5. During printing, the card is transported so as to be positioned so that the character 4, when printed, is printed at the proper location on the card. The card is then repositioned using the card transport mechanism to print the character 3 at the proper location on the card. This process repeats for each character subset with the card being transported in forward or reverse directions until the entire character string is printed. The end result is the character string, such as the account number 16*c*, being printed on the card as depicted in FIG. 1.

FIG. 7 depicts a portion 84 of the print ribbon 38 of FIG. 2 used to print the account number 16*c*. The printing of the account number 16*c* in the order determined by the metadata in FIG. 6B results in a residual image 86 of the characters of the account number 16*c* being left on the print ribbon 38. Because the character subsets are printed in a sequence that differs from the actual sequence of the printed characters in the character string, the characters in the residual image 86 have a sequence that matches the sequence in which the character subsets are printed, which differs from the sequence of the characters printed on the card. As a result, one cannot discern the account number or other character string from viewing the residual image left behind on the print ribbon 38.

FIG. 8 illustrates an example of a card processing system 100 that can include the plastic card printing system described herein. The system 100 can include a plastic card printer 102 that can be similar to the plastic card printer 32 of FIG. 2. A card printer terminal 104 is in wired or wireless communication with the card printer 102 that can be used to initiate a print job. The card printer terminal 104 can be, but is not limited to, a local personal computer, a laptop computer, a tablet computer, a mobile phone, and the like. A server 106 is in wired or wireless communication with the card printer terminal 104 and/or optionally directly with the card printer 102. The data renderer 50 described above in FIG. 2 can reside in the server 106 or in the card printer terminal 104 for generating the rendered data. Therefore, in some embodiments, print commands, division of the character string into character subsets, and generation and assignment of the metadata to each character subset can take place in the server 106. In other embodiments, print commands, division of the character string into character subsets, and generation and assignment of the metadata to each character subset can take place in the card printer terminal 104. A card management system 108 may be in wired or wireless communication with the server 106 to authorize print jobs, provide cardholder data to be printed to the server, and generate the desired card format or card layout of the data. In some embodiments the data renderer 50 described above in FIG. 2 for generating the rendered data can reside in the card management system 108.

In FIG. 8, the card printer 102 is configured as a desktop card printer that is typically designed for relatively smaller scale, individual card personalization in relatively small volumes, for example measured in tens or low hundreds per hour, often times with a single card being processed at any one time. These card printers are often termed desktop card printers because they have a relatively small footprint intended to permit the card printer to reside on a desktop. Many examples of desktop card printers are known, such as the SD or CD family of desktop card printers available from Entrust Corporation of Shakopee, Minn. Other examples of desktop card printers are disclosed in U.S. Pat. Nos. 7,434,728 and 7,398,972, each of which is incorporated herein by reference in its entirety.

FIG. 9 illustrates another example of a card processing system 110 that can include the plastic card printing system described herein. The system 110 is configured to process a plurality of cards at the same time. The system 110 can include a plastic card printer 112 that can be similar to the plastic card printer 32 of FIG. 2. The system 110 can further include a card input 114, an optional station 116 configured to program an integrated circuit chip and/or encode a magnetic stripe on each card, optionally one or more additional card processing stations 118 between the station 116 and the card printer 112, optionally one or more additional card processing stations 120 downstream from the card printer 112, and a card output 122. In addition, a controller 124 controls operation of each of the stations or mechanisms 112-122. The print controller 40 described above in FIG. 2 can reside in the controller 124. In addition, the data renderer 50 described above in FIG. 2 for generating the rendered data can reside in the controller 124 or the data renderer 50 can be separate from the controller 124 and separate from the system 110 or incorporated into the system 110

The card input 114 can be configured to hold a plurality of plastic cards waiting to be processed and that mechanically feeds the plastic cards one by one into the system 110 using a suitable card feeder. In this configuration, the card input 114 is often termed a card input hopper. The construction and operation of card inputs and card input hoppers is well known in the art. The card input 114 can be configured with a multihopper configuration where the card input 114 is configured to simultaneously hold different card stock (for example, Visa® and Mastercard® branded card stock; driver's license card stock from different states; identification card stock having different security levels; etc.) waiting to be processed. Each type of card stock can be selectively input into the system 110 as selected by the system controller 124 based on the type of card to be created. In another embodiment, the card input 114 can be configured as an input slot that permits cards to be manually fed one by one into the system 110.

The station 116 can include a chip read/write device that is configured to perform contact or contactless testing on an integrated circuit chip on each card to test the functionality of the chip, read data from each chip and/or program data onto each chip. The construction and operation of chip read/write devices in card processing systems is well known in the art. The station 116 can also or alternatively include a magnetic stripe read/write device that is configured to read data from and/or write data to a magnetic stripe on each card. The construction and operation of magnetic stripe read/write devices in card processing systems is well known in the art.

The one or more additional card processing stations 118, 120 can be stations that are configured to perform any type of additional card processing. Examples of the additional card processing stations 118, 120 include, but are not limited to, an embossing station having an embosser configured to emboss characters on the cards, an indent station having an indenter configured to indent one or more characters on the cards, a laser marking station with a laser configured to perform laser marking on the cards, a lamination station with a laminator configured to apply one or more laminates to the cards, a topcoat station with a topcoat applicator configured to apply a topcoat to one or more of the surfaces of the cards, a security station with a security feature applicator configured to apply a security feature to one or more of the surfaces of the cards, and one or more card reorienting mechanisms/flippers configured to rotate or flip a card 180 degrees for processing on both sides of the cards.

The card output 122 can be configured to hold a plurality of plastic cards after they have been processed. In this configuration, the card output 122 is often termed a card output hopper. The construction and operation of card output hoppers is well known in the art. Like the card input 114, the card output 122 can also be configured with a multihopper configuration where the card output 122 is configured to simultaneously hold different card stock (for example, Visa® and Mastercard® branded card stock; driver's license card stock from different states; identification card stock having different security levels; etc.) after they have been processed. Each type of card stock can be selectively output from the system 110 as selected by the system controller 124 based on the type of card that has been processed. In another embodiment, the card output 122 can be configured as an output slot from which the processed cards are discharged one by one from the system 110.

The type of system illustrated in FIG. 9 is a large volume batch production card processing system (or central issuance processing system) that processes cards in high volumes, for example on the order of high hundreds or thousands per hour, employs multiple processing stations or modules to process multiple cards at the same time to reduce the overall per card processing time. Examples of such large volume card processing machines include the MX and MPR family of central issuance processing machines available from Entrust Corporation of Shakopee, Minn. Other examples of central issuance processing machines are disclosed in U.S. Pat. Nos. 4,825,054, 5,266,781, 6,783,067, and 6,902,107, all of which are incorporated herein by reference in their entirety.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A plastic card printing system comprising:

a plastic card printer having a printing mechanism that includes a thermal printhead and a thermal print ribbon;

a data renderer that is configured to render print data to print a character string composed of a plurality of characters on a plastic card using the thermal printhead and the thermal print ribbon, the data renderer divides the character string into a plurality of character subsets prior to printing of the character string, the character subsets having a character subset sequence, and the data renderer associates metadata with each character subset that determines a printing sequence of the character subsets and a printing position of each character subset on the plastic card, wherein the printing sequence differs from the character subset sequence so that a sequence of characters in a residual image left on the thermal print ribbon after printing of the character string differs from the sequence of the characters in the character string printed on the plastic card.

2. The plastic card printing system of claim 1, wherein the data renderer is remote from the plastic card printer.

3. The plastic card printing system of claim 1, wherein the data renderer is part of the plastic card printer.

4. The plastic card printing system of claim 1, wherein the character string comprises a portion of a personal account number assigned to an intended holder of the plastic card.

5. The plastic card printing system of claim 1, wherein the plastic card printer further comprises a reversible card transport mechanism that transports a plastic card within the plastic card printer in forward and reverse directions during printing of the character string.

6. The plastic card printing system of claim 1, wherein the character subset sequence is not rearranged prior to printing of the character string.

7. The plastic card printing system of claim 1, wherein the data renderer is part of a rendering engine that also renders one or more images to be printed.

8. A plastic card printing system comprising:

a plastic card printer having a printing mechanism that includes a thermal printhead and a thermal print ribbon, a mechanical card transport mechanism, and a print controller that controls operation of the printing mechanism;

a data renderer separate from and in communication with the print controller, the data renderer processes data to be printed on a plastic card in a manner so that a residual image left on the thermal print ribbon after printing of the data differs from the data printed on the plastic card.

9. The plastic card printing system of claim 8, wherein the print controller controls the mechanical card transport mechanism.

10. The plastic card printing system of claim 8, wherein the data renderer is separate from, but in communication with, the plastic card printer.

11. The plastic card printing system of claim 8, wherein the data renderer is incorporated into the plastic card printer.

12. The plastic card printing system of claim 8, wherein the data to be printed on the plastic card comprises a plurality of characters, and a sequence of the characters in the residual image left on the thermal print ribbon after printing of the data differs from the sequence of the characters printed on the plastic card.

13. The plastic card printing system of claim 8, wherein the plastic card printing system comprises a desktop card printer or a central issuance processing system.

14. A method of printing data on a plastic card in a plastic card printer of a plastic card printing system, comprising:

inputting the plastic card to be printed into a printing mechanism of the plastic card printer using a mechanical card transport mechanism, the printing mechanism includes a thermal printhead and a thermal print ribbon, and a print controller of the plastic card printer controls operation of the printing mechanism; and processing data to be printed on the plastic card in a data renderer that is separate from and in communication with the print controller, and the data renderer processes the data in a manner so that a residual image left on the thermal print ribbon after printing of the data differs from the data printed on the plastic card.

15. The method of claim 14, further comprising using the print controller to control the mechanical card transport mechanism.

16. The method of claim 14, wherein the data renderer is separate from, but in communication with, the plastic card printer.

17. The method of claim 14, wherein the data renderer is incorporated into the plastic card printer.

18. The method of claim 14, wherein the data to be printed on the plastic card comprises a plurality of characters, and a sequence of the characters in the residual image left on the thermal print ribbon after printing of the data differs from the sequence of the characters printed on the plastic card.

19. The method of claim 14, wherein the plastic card printing system comprises a desktop card printer or a central issuance processing system.

* * * * *